United States Patent [19]

Sartain

[11] 4,323,176

[45] Apr. 6, 1982

[54] MANUALLY-OPERABLE RATCHET TYPE DISPENSER FOR COMESTIBLES

[75] Inventor: John R. Sartain, Irvine, Calif.

[73] Assignee: Taco Bell, Irvine, Calif.

[21] Appl. No.: 168,060

[22] Filed: Jul. 11, 1980

[51] Int. Cl.[3] ..... B65D 88/54

[52] U.S. Cl. ..... 222/326; 222/391

[58] Field of Search ..... 222/325, 326, 327, 391; 184/28, 38 R

[56] References Cited

U.S. PATENT DOCUMENTS

| | | | |
|---|---|---|---|
| 1,672,421 | 6/1928 | Negley | 222/391 |
| 2,180,978 | 11/1939 | Crewe | 222/391 X |
| 2,367,347 | 1/1945 | Good | 222/391 X |
| 2,884,877 | 5/1959 | Nalbone et al. | 222/391 |
| 3,161,325 | 12/1964 | Hinkel et al. | 222/391 X |
| 3,920,156 | 11/1975 | Hicks | 222/391 X |
| 4,213,546 | 7/1980 | Massey | 222/326 X |

*Primary Examiner*—G. Weidenfeld
*Assistant Examiner*—Fred A. Silverberg
*Attorney, Agent, or Firm*—Scully, Scott, Murphy & Presser

[57] ABSTRACT

A dispenser for comestibles having a container which is supported by a casing. The casing has a frame there which, in turn, supports an axially movable ratchet mechanism. The ratchet is moved by an actuator which is operatively interconnected with a handle each manipulation of which will advance the ratchet by one tooth pitch towards the container. The container has a piston head formed on its bottom wall and engaged by the ratchet end. The advance of the ratchet, will cause the bottom of the container to move into the container so as to displace an equal volume comestible and force the displayed quantity of comestible out of a container dispensing orifice.

4 Claims, 4 Drawing Figures

MANUALLY-OPERABLE RATCHET TYPE DISPENSER FOR COMESTIBLES

BACKGROUND OF THE INVENTION

1. Field of the Invention

This invention relates generally to a novel dispenser for comestibles and, more particularly, pertains to an inexpensive food dispenser capable of dispensing predetermined measured quantities of food or condiment.

Food dispensers are extensively used in commercial establishments and in the fast-food industry. A need has arisen in the fast-food industry for dispensers which accurately control and measure the quantities of different types of food dispensed to each customer. Specifically, although not limited thereto, the type of commercial dispenser that the invention relates to is a sour cream or similar food product dispenser in which a container is supported on a ratchet-operated mechanical arrangement which enables the user to dispense a precisely measured quantity of food or condiment in response to each manipulation of the ratchet mechanism.

2. Discussion of the Prior Art

The inventive arrangement effectively provides a dispenser which is inexpensive to manufacture, maintain and service and which enables the user to dispense predetermined measured amounts of food at each operation thereof. Food dispensers currently used in modern restaurants are normally of the collapsible cylinder type having a tapered dispensing end. The user merely squeezes the dispenser, collapsing the sides of the cylinder so as to create an increase in pressure on the contents within the cylinder and, consequently, forcing the food out along the tapered end of the cylinder. These dispensers do not have the ability to accurately dispense predetermined measured amounts of food. As a result, there is present a high degree of inefficiency and waste in dispensing such food when being used in fast-food and other types of restaurants, this of necessity leading to considerable economic losses and reduced profits, and presenting a non-uniform product to subsequent customers.

Another problem associated with this inherent inefficiency of currently employed food dispensers lies in the inability of the management of personnel of the particular restaurant or food establishment to keep accurate inventory of the dispensed foods. Without the availability an accurate tally of the daily volume of different kinds of foods dispensed, management cannot effectively project the needs of the establishment in the ordering of future supplies and in the keeping of an accurate inventory. This problem can become quite severe in daily, high volume, restaurants, such as fast-food establishments.

The present invention, is in essence, a novel dispenser in which a food product-filled container is mounted on a ratchet-operated mechanical device whereby each manipulation of the ratchet arrangement causes an inward displacement of the container bottom thereby forcing a predetermined amount of the product out of the container. Dispensers incorporating similar arrangements are not known in the food dispensing art. In the technically related art of caulking and grease guns, mechanical dispensers have been in wide and common use. Unlike the prior art, of which Plumer U.S. Pat. No. 3,640,431, Dessureault U.S. Pat. No. 3,687,339, Basa U.S. Pat. No. 3,782,598 and Subwick U.S. Pat. No. 4,126,251 are representative, the present invention uses a relatively simple and inexpensive arrangement to achieve the desired results. Further, in contrast with the prior art, the present invention utilizes a plastic structure so as to comply with government-regulated safety and health standards relating to the packaging, storing and dispensing of comestibles.

As illustrated in Plumer U.S. Pat. No. 3,640,431, a metal arrangement is provided for dispensing mastic material. Plumer discloses a caulking cartridge in which predetermined amounts of a caulking compound are dispensed responsive to actuation of a ratchet which, in turn, displaces the bottom of the cartridge inwardly. However, Plumer does not provide consideration of the problems of maintenance or the ease of assembly towards which the present invention is directed. Moreover, Plumer does not provide for replaceable and interchangeable ratchets of different configurations which facilitate varying amounts of product dispensed from the cartridge at each manipulation of the ratchet mechanism.

Dessureault U.S. Pat. No. 3,687,339 discloses a tooth paste dispenser which utilizes a disposable cartridge, and a plunger and lever mechanism for dispensing the paste. Dessureault's device is directed towards a complicated apparatus for the dispensing of tooth paste. Particularly, Dessureault relies on a disposable cartridge adapted to alleviate any problems associated with the internal cleanliness of the product within the dispenser. Additionally, there is no provision of a removable ratchet and hand tools must be employed for the assembly of the structure.

Basa U.S. Pat. No. 3,782,598, discloses a dispenser having a coiled spring as the element through the action of which the dispenser ejects the contents. This relatively complex device is an expensive and cumbersome solution to the above-mentioned problems. Further, Basa's device is not used to dispense predetermined measured amounts of a comestible but rather continuously dispenses its contents while the trigger is maintained depressed, unlike the present invention which dispenses discrete amounts of food at each separate manipulation by the operator of the dispensing device.

Subwick U.S. Pat. No. 4,126,251 discloses a novel pressure releasing device which is utilized in conjunction with caulking guns and is merely referred to herein as illustrative of the general state of the related art.

SUMMARY OF THE INVENTION

Accordingly, it is a primary object of the present invention to provide an improved dispenser capable of accurately dispensing predetermined and discrete quantities of a comestible.

Another object of the present invention is to provide a dispenser which can be easily modified to dispense varying discrete amounts of a comestible in dependence upon the need of a user.

A further object of the present invention is the provision of a dispenser for comestibles which can be easily assembled and disassembled without the need for hand tools, rendering simple any servicing and replacement of parts, as well as facilitating ease in the cleaning of the dispenser components.

The present invention provides a novel apparatus for dispensing food in accurately calibrated discrete amounts which incorporates a ratchet arrangement to cause an inward displacement of a separable container bottom so as to cause the dispensing of a predetermined amount of product from the container at each manipulation of the ratchet arrangement.

BRIEF DESCRIPTION OF THE DRAWINGS

The foregoing and other objects, advantages and characterizing features of the inventive food dispenser will become more readily apparent from the following detailed description of a preferred embodiment thereof, taken in conjunction with the accompanying drawings wherein like reference numerals denote similar parts throughout the various views; and in which.

DESCRIPTION OF THE PREFERRED EMBODIMENTS

Figure 1:
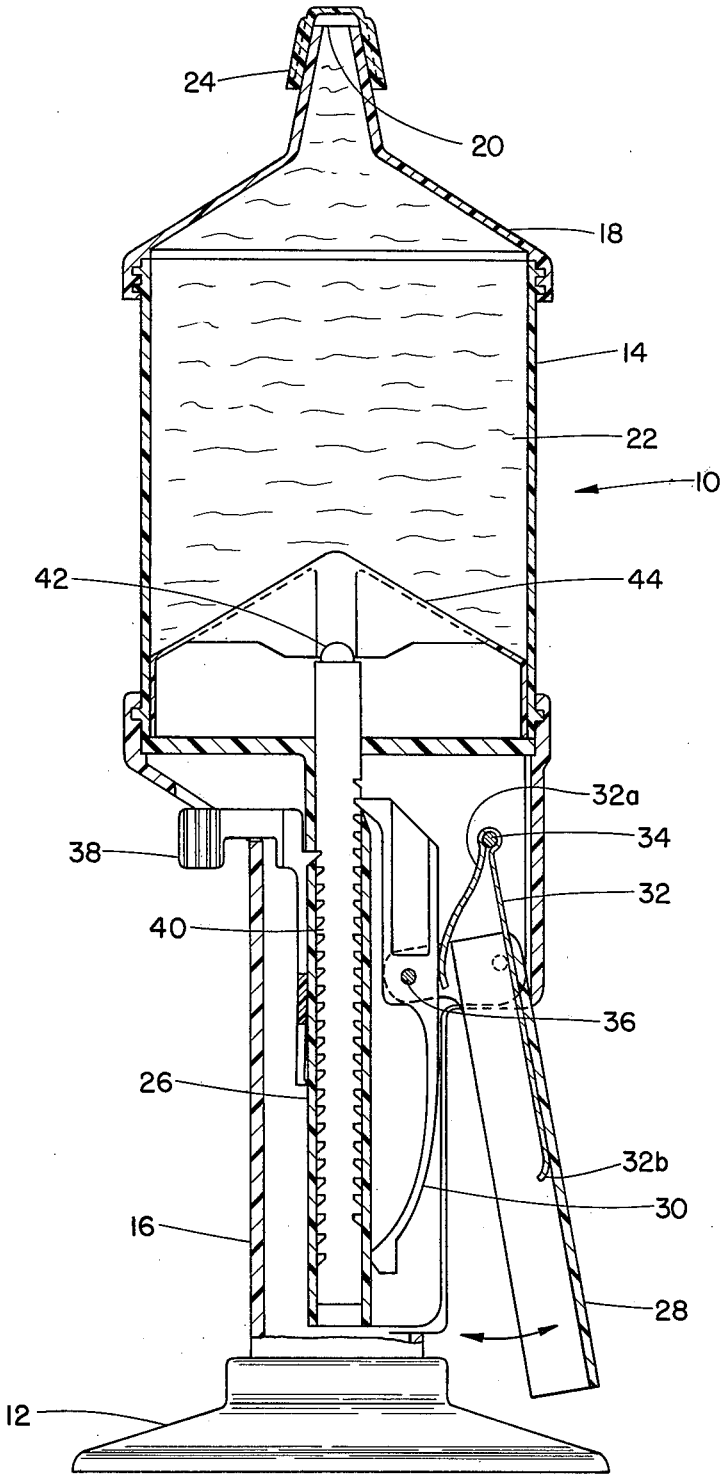
FIG. 1 is a side elevational view of a dispenser of the present invention with portions broken away and shown partially in cross section to more clearly illustrate the internal structure thereof.
Figure 2:
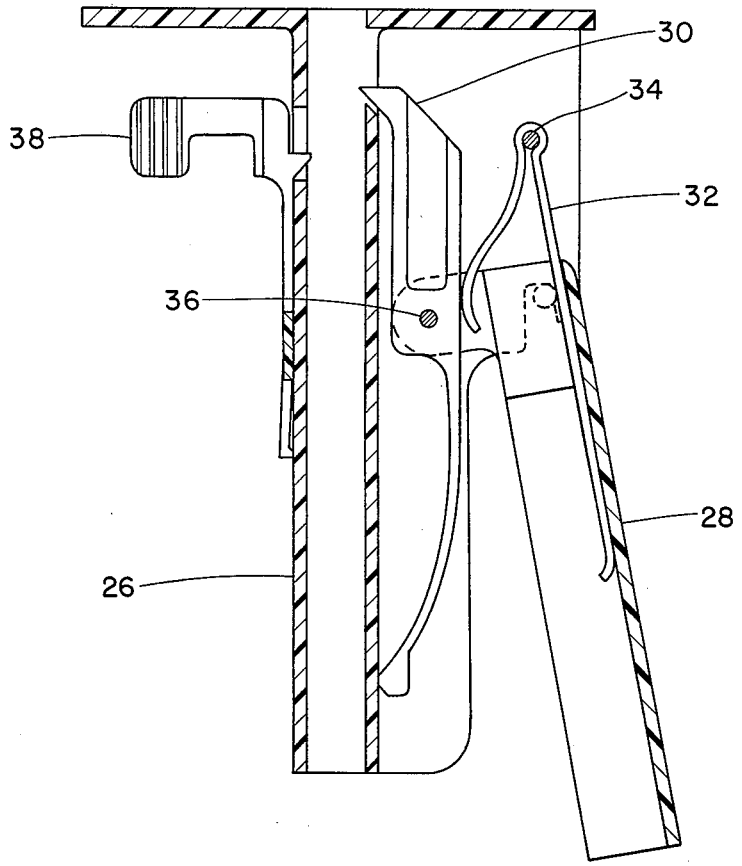
FIG. 2 illustrates an elevational sectional view of the ratchet actuating sub-assembly.
Figure 3:
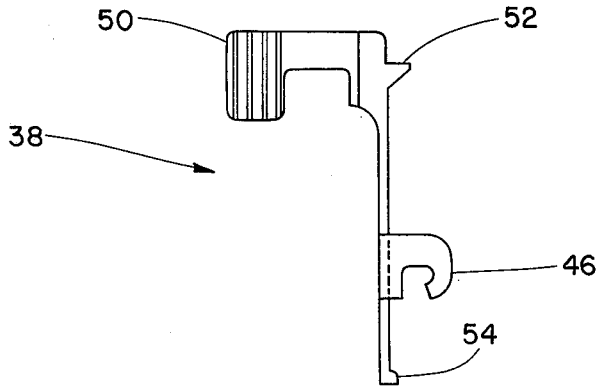
FIG. 3 is a side elevational view of the latch.
Figure 4:
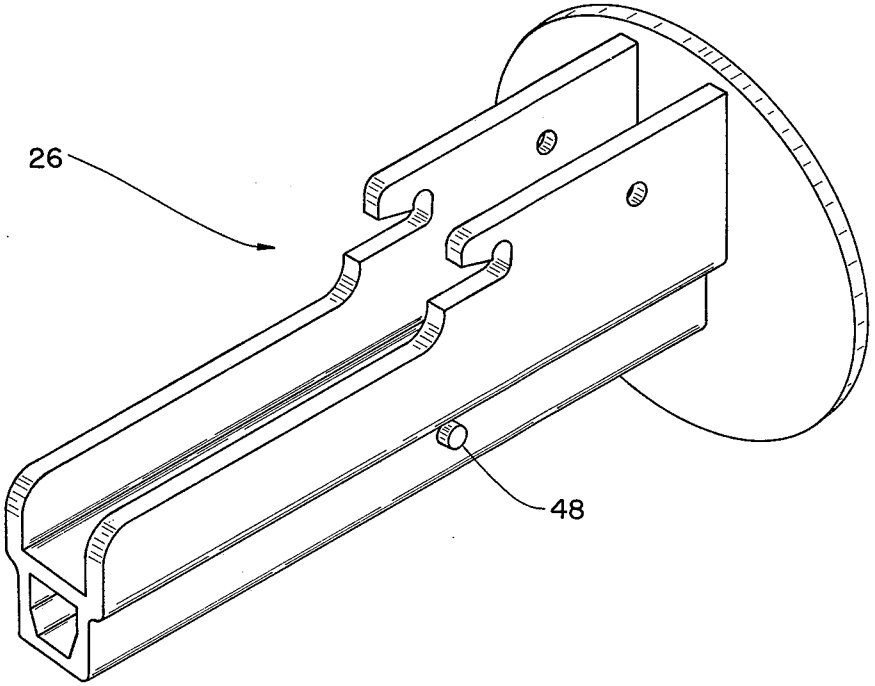
FIG. 4 is a perspective view of the frame section of the dispenser.

Referring now in detail to the drawings, in FIG. 1 there is shown a dispenser 10 constructed in accordance with the teachings of the present invention having a support base 12 attached thereto. The dispenser 10 consists of a container 14 which is threadedly attached at one end thereof to a casing 16. The container 14 and casing 16 are preferably constructed of a rigid plastic material. A container top 18 is fastened to the other end of the container 14, preferably threaded thereto, and is further provided with an opening 20 forming a product-dispensing orifice. The container top 18 directs the flow of a comestible 22 which is to be dispensed from the container 14 through the outlet orifice 20. A cap 24 is provided in order to seal the opening 20 and to prevent leakage and the entry of external matter when the dispenser 10 is not in use. The casing 16 is adapted to slidably receive the ratchet actuating sub-assembly which is basically constituted of a frame 26 having an actuating handle 28 attached thereto. The handle 28 is operatively interconnected with the ratchet actuator 30 by a spring 32. The spring 32 and the actuator 30 are both attached to the frame 26 by use of pins 34, 36, respectively with the spring 32 normally biasing the handle 28 outwardly of the frame 26 about pin 36. The pins 34, 36 may both be made of metal, such as stainless steel, but are heat-staked into a position which forms a plastic covering over the ends of the pins. The actuator pin 36 also interconnects the handle 28 to the frame 26. The spring 32 is looped around the spring pin 34 whereby one arm **32*a* of the spring is braced against the actuator 30 and another lengthier arm 32*b* is braced against the handle 28. The ratchet actuating sub-assembly further includes a latch 38. A ratchet 40 is positioned to extend coaxially within the frame 26 and is adapted to be axially displaced when the handle 28 is depressed and the latch 38 is pivoted outwardly from the frame 26. The ratchet 40 can then be positioned or removed for easy cleaning or replacement. It should be understood that the ratchet, upon disassembly, can be removed and replaced by another ratchet having teeth with a different pitch. By so doing an operator can easily alter the predetermined amount of comestible to be dispensed with each handle 28 actuation. The ratchet 40 extends upwardly beyond the frame 26 and into the bottom end of the container 14. The ratchet terminates in a ratchet tip 42 which further projects so as to engage into the container 14. Placed immediately above and adjacent to the tip 42 is the conical piston head 44 forming the container bottom which is slidably fit into the container 14 and remains entirely therein. The arrangement of the handle 28, spring 32, and actuator 30 is adapted to move the ratchet 40 upwardly by one notch into the container 14 at each squeezing operation of the handle 28 by the user. The latch 38 is provided with a tooth or dog 52 engaging the ratchet 40 so as to prevent the latter from returning to its original position. The latch 38 is hinged to the frame 26 by means of pegs 48 on the frame. The latch 38 is further provided with a tab 50 which projects outwardly through the casing 16 enabling the latch to be manually disengaged from the ratchet 40. Finally, the latch 38 has a base 54 which imparts constant pressure to the tooth 52 so as to maintain the tooth in constant contact with the ratchet 40** throughout the dispensing cycle.

In operation, the operator presses handle 28 radially inwardly towards the frame 26. The handle compresses spring 32 which flexes the actuator 30. The actuator which has a pawl engaged with the teeth of ratchet 40 flexes and pushes the ratchet 40 upwardly by one tooth or notch towards the piston head 44. The ratchet tip 42 pushes the piston head 44 upwardly into the container 14 by the axial distance defined by one pitch length of the ratchet teeth and which, in turn, pushes a predetermined quantity of comestibles 22 in the container upwardly through the container top 18 and out of the orifice 20. Just before the actuator 30 completes its upward push, the tooth on the latch 38 engages the next lower tooth on the ratchet 40 thereby preventing the ratchet 40 from moving downwardly or away from the piston head 44.

In order to assemble the dispenser, the ratchet actuating sub-assembly is assembled through conventional procedures. The handle 28 is depressed and the sub-assembly is slidably received within the casing 16. The support base 12 and the container 14 are attached to the casing. The ratchet 40 is then positioned in the center portion of frame 26. The piston head 44 is then positioned within the container immediately above and contiguous to the ratchet tip 42. The comestible 22 is located within the container 14 with the container top 18 being positioned on the top of the container 14 and with cap 24 sealing the container. Generally, the comestible is of a semi-flowable type, in essence, having a paste-like or mucilagenous consistency. To disassemble the dispenser 10, the above steps are carried out in a reverse order. This description is included to illustrate the ease of assembly and disassembly the invention incorporates. This ease of disassembly provides for ready cleaning and easy servicing or replacement of any of the dispenser components.

From the foregoing it is apparent that the objects of the present invention have been fully accomplished. As a result of the present invention, a novel dispenser for comestibles has been provided. Although a preferred embodiment of the principles of this invention has been described and illustrated in detail herein, it should be realized that the same are not limited to the particular configuration shown in the drawings, and that modifications thereof are contemplated and can be made without departing from the broad spirit and scope of this invention as defined in the appended claims.

What is claimed is:

1. An apparatus for discretely dispensing predetermined quantities of a comestible comprising:

a. a container having an open bottom and a quantity of comestible disposed therein; said container having a dispensing orifice; a piston head having a substantially conical shape positioned along the open bottom of said container in order to retain the comestible within the container; a means for moving said piston head upwardly into the container;

b. a casing having said container removably mounted thereon; a frame slidably received within said casing, said frame positioned immediately below said piston head to provide support therefor, an elongate ratchet member axially and slidably arranged in said frame; said ratchet extending upwardly through the frame so as to contact said piston head; and c. an actuating means comprising a flexible pawl connected to said ratchet; a handle pivotally connected to said casing, said pivotal connection including a pin and a spring means positioned between and interconnecting said handle and said pawl so as to enable the movement of the handle to flex the flexible pawl whereby upon such flexing the pawl incrementally advances said ratchet member towards the piston head and displaces the head upwardly into the container so as to dispense a quantity of comestible corresponding to the displaced volume in said container, said frame having a latch means, said latch means comprising a pawl having a tab extending from within the casing, said pawl being attached to pegs extending from said frame, said pawl being positioned on the opposite side of the ratchet relative to said handle, said pawl having a tooth which engages said ratchet on the opposite side that the flexible pawl engages the ratchet to restrain the ratchet from movement away from the container.

2. A dispenser as defined in claim 1, said pawl being connected to the ratchet to advance the ratchet one tooth upwardly so as to force the piston head upwardly a distance equal to the pitch of said tooth.

3. A dispenser as claimed in claim 2, said ratchet member being replaceable by a ratchet member having a different tooth pitch for varying the quantities of the comestible being dispensed from said container at each manipulation of said handle.

4. A dispenser as claimed in claim 1, said dispenser components being essentially constituted of plastic material.

* * * * *